US005426893A

United States Patent [19]

Hoffman

[11] Patent Number: 5,426,893

[45] Date of Patent: Jun. 27, 1995

[54] REINFORCED SECTIONAL STORM PANEL

[76] Inventor: Robert E. Hoffman, 5618 Riviera Dr., Coral Gables, Fla. 33146

[21] Appl. No.: 249,713

[22] Filed: May 26, 1994

[51] Int. Cl.[6] ..... E06B 3/32

[52] U.S. Cl. ..... 49/464; 49/50; 52/202

[58] Field of Search ..... 49/464, 61, 50, 62; 52/202

[56] References Cited

U.S. PATENT DOCUMENTS

| | | | |
|---|---|---|---|
| 2,878,536 | 3/1959 | Becker | 49/464 X |
| 3,129,793 | 4/1964 | Ferrell | 52/202 X |
| 4,333,271 | 6/1982 | DePaolo et al. | 49/464 |
| 4,685,261 | 8/1987 | Seaquist | 52/202 |
| 5,345,716 | 9/1994 | Caplan | 49/464 X |

*Primary Examiner*—Philip C. Kannan
*Attorney, Agent, or Firm*—Harness, Dickey & Pierce

[57] ABSTRACT

A storm panel is formed of a large number of elongated, narrow, thin panel sections that are arranged along a common plane and are connected together edge-to-edge. Each section has an integral flange forming a tongue extending along one of its longitudinal edges. Also, each panel has a pair of approximately parallel spaced apart flanges formed integral with its opposite edge to provide a channel of a depth and width for tightly receiving a tongue. The tongue of each section is manually fitted within and tightly held within the channel of the next adjacent section. The overlapping, narrow flanges forming the tongues and grooves at each adjacent pair of section edges provide a three-layer, narrow, bar-like reinforcement strip extending the full length of the panel. The series of reinforcement strips formed along the assembled panel, stiffen, strengthen and increase the resistance of the panel to penetration by forcefully applied objects, such as wind hurled debris during storms.

6 Claims, 2 Drawing Sheets

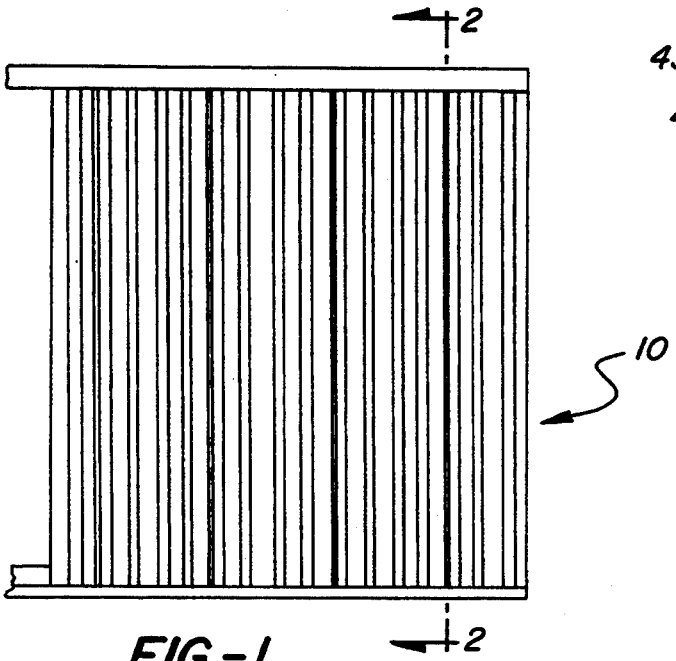
FIG-1
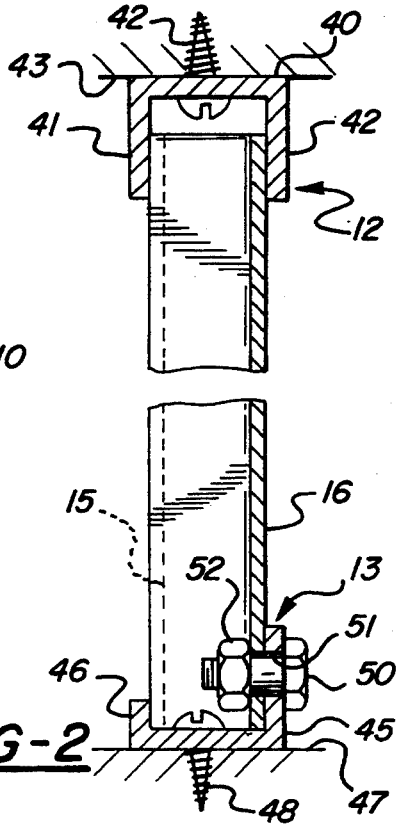
FIG-2
FIG-3
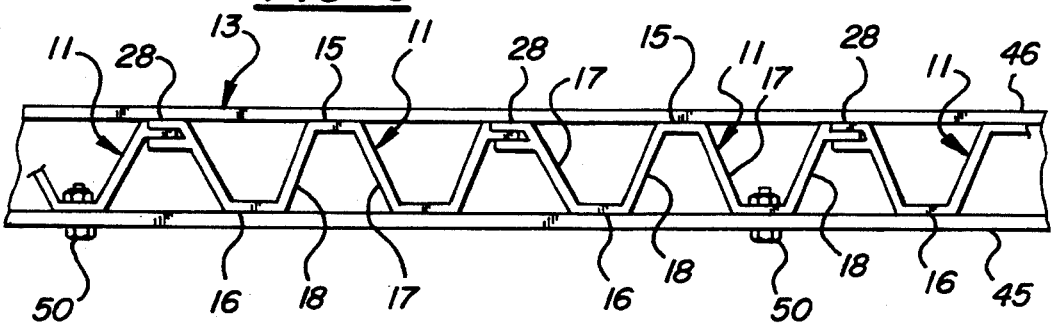
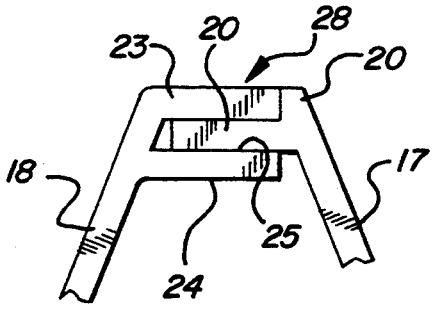
FIG-4
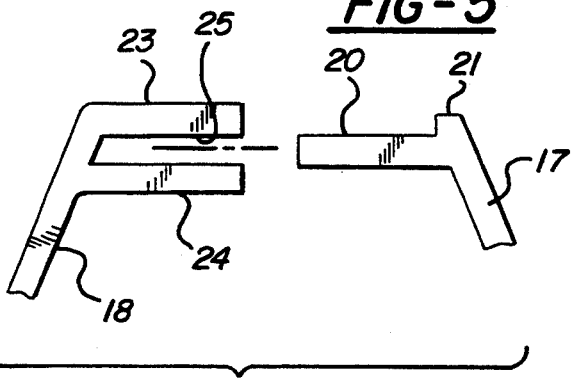
FIG-5

REINFORCED SECTIONAL STORM PANEL

BACKGROUND OF THE INVENTION

This invention relates to an improved sectional-type storm panel which is rigidified and reinforced to resist penetration by forcefully applied objects, such as wind borne debris during a storm.

In high wind storm areas, such as hurricane susceptible areas, it is common to apply storm panels across window, door and the like openings in buildings when storm warnings are received to protect against damage from the wind and from wind blown debris. One conventional form of storm panel comprises a number of elongated sections, usually vertically arranged, that are aligned edge-to-edge along a generally common plane. Typically, the adjacent edges of each section are overlapped. The overlapped areas may remain loosely in contact or may be fastened together with screws or nuts and bolts and the like. The sections are manually assembled together when storm warnings are received and the panel, typically, is assembled within a downwardly opening header channel located along the upper portion of the opening to be covered and upwardly opening channel forming a sill at the lower edge of the opening to be covered.

During non-use, the sections are disassembled and stored. When the sections are fastened together along the edges, considerable time is needed to apply the fasteners and, conversely, to remove the fasteners and disassemble the panel after a storm passes. Consequently, it is common to dispense with mechanical fasteners and to merely overlap the adjacent edges of aligned sections when the panel is required to protect a building against a rapidly approaching storm.

Conventional storm panels may be made of corrugated metal as, for example, extruded corrugated aluminum which is a relatively thin material. That type of material has a limited ability to withstand and prevent penetration of debris being hurled about during high winds. Consequently, recently enacted governmental regulations in areas subjected to frequent high velocity wind storms, such as hurricanes, require that storm panels be reinforced sufficiently to resist and prevent penetration by rapidly moving objects, such as large pieces of wood and the like. Conventional storm panels as described above, in general, cannot meet that requirement.

The present invention is concerned with modifying and improving conventional sectional type storm panels to greatly increase their resistance to penetration by wind borne debris.

DESCRIPTION OF INVENTION

This invention contemplates forming a storm panel out of numerous, narrow, extruded metal or plastic sections, which may be corrugated, and which are arranged in a common plane, in an edge-to-edge relationship. One edge of each section is formed with a narrow, integral flange extending along its length. The opposite edge of each section is provided with a pair of narrow, integral flanges which are spaced apart to form a channel of a width and depth to receive the single flange of the next adjacent section. When the panel is assembled, the single flanges, which form tongues, of each section are forcefully fitted within the channels formed on the next adjacent section edges and are tightly held within the channels by the friction and the resiliency of the channel flanges.

A three-layer, bar-like, narrow strip is formed at the intersection or connection between each pair of sections. Since the sections are relatively narrow, the overall panel, in effect, has numerous closely spaced reinforcing bars located at the intersection of each pair of sections. These parallel bar-like reinforcing strips rigidify, strengthen and increase the resistance of the assembled panel against flying debris and other forcefully striking objects. Consequently, although the sections may be formed of relatively thin extrusions, the assembled panel is provided with greatly increased strength because of the lamination or layer configuration of the edges of the section.

An object of this invention is to provide an inexpensive, simple, modification to an otherwise conventional section type of storm panel which can be quickly assembled manually without the need for mechanical fasteners joining the edges of the sections together and without leaving the overlapped edges loose.

Another object of this invention is to provide a tongue and groove formation along the elongated edges of each section of a storm panel of the sectional type, which form laminated, bar-like strips extending along the vertical height of the panel for substantially reinforcing the assembled panel.

Yet another object of this invention is to provide a section connection system for a section-type storm panel which, in effect, produces a series of vertical bar-like reinforcing strips extending from top to bottom of the panel for reinforcing the panel and enabling the panel to withstand penetration by high velocity, wind hurled debris.

These and other objects and advantages of this invention will become apparent upon reading the following description, of which the attached drawings form a part.

DESCRIPTION OF DRAWINGS

FIG. 1 is an elevational view of an assembled storm panel.

FIG. 2 is an enlarged, fragmentary view taken in the direction of arrows 2—2 of FIG. 1.

FIG. 3 is an enlarged plan view, looking downwardly, at several panel sections assembled together edge-to-edge.

FIG. 4 is an enlarged, fragmentary view, of interfitted tongue and groove forming flanges which provide reinforcing strips.

FIG. 5 is an enlarged, fragmentary view, showing the tongue flange of one panel section aligned for insertion within the groove formed in the next adjacent panel section edge.

DETAILED DESCRIPTION

FIG. 1 illustrates an assembled storm panel 12 which is made of numerous narrow, elongated panel sections 11 that are connected together edge-to-edge. The assembled panel may be held in place, as a closure over a door or window opening area or the like, by means of a header or upper channel 12 and a sill or lower channel 13.

Figure 6:
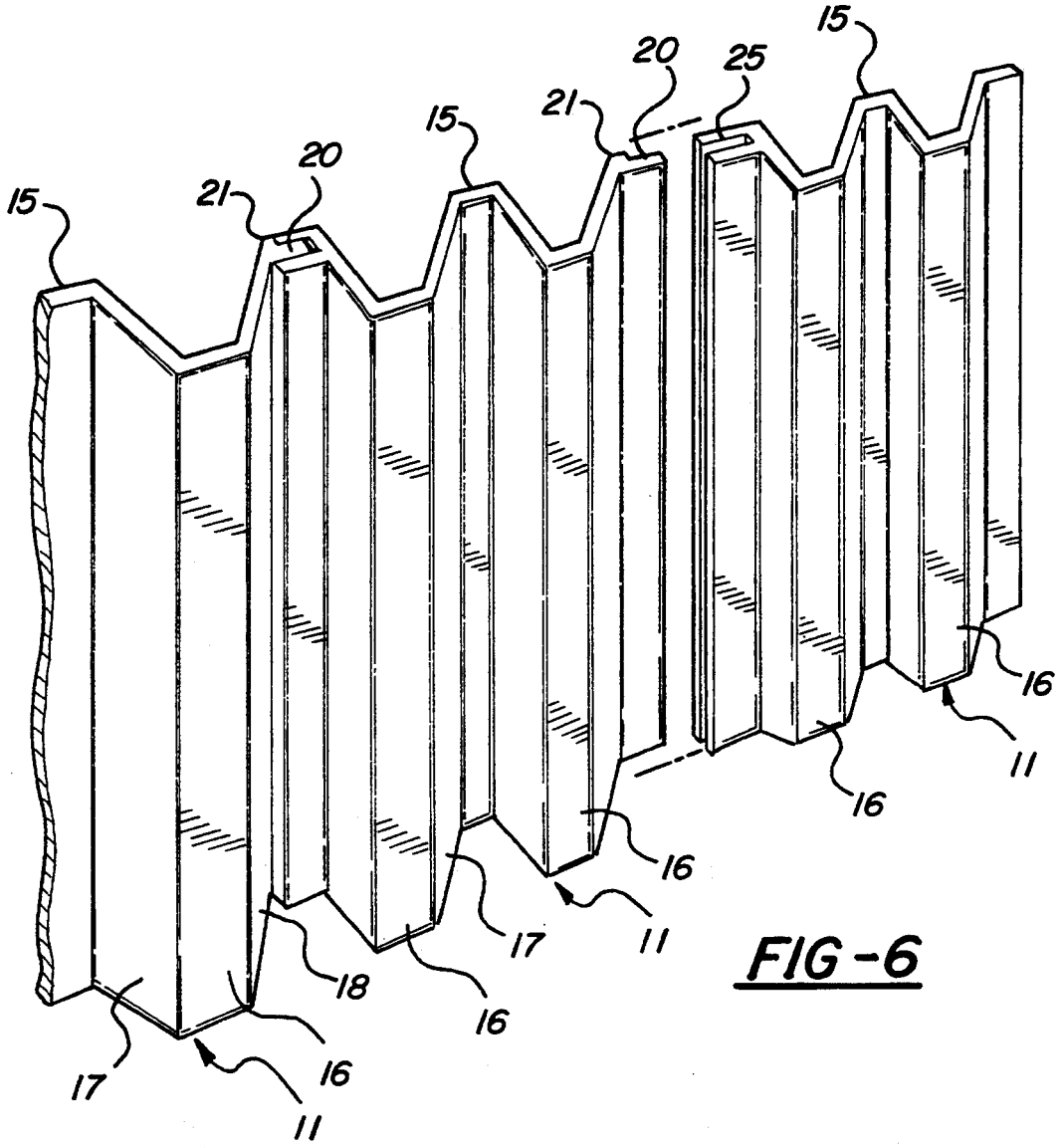
FIG. 6 is an enlarged, fragmentary, perspective view showing adjacent, aligned panel sections.

The panel sections 11 are preferably formed of aluminum or of plastic extrusions and may be extruded or roll formed into a corrugated or bent cross-sectional configuration. As illustrated in FIGS. 3 and 6, each section is formed, in cross-section, with a front base portion 15, rear base portions 16, which are interconnected by angled side strip portions 17 and 18. By way of example, an extruded aluminum panel section could be approximately one-eighth of an inch thick, with bases which are approximately slightly less than two inches in width and side strips that are angled at approximately 30 degrees to the planes of the bases. The overall thickness of the corrugated or bent panel sections may be approximately two inches. The width of the sections, in this example, would be approximately twelve inches and the height would vary, such as on the order of seven feet, as necessary to extend the vertical distance across an opening to be covered by the panel. The foregoing dimensions are by way of example and, may be varied considerably in actual practice.

The panel sections are arranged along a common plane in an edge-to-edge relationship. Adjacent panel section edges are interconnected by means of tongue and groove joints which, also, function to provide reinforcing bar-like strips, as will be described below.

One longitudinal, vertical edge of each panel section is provided with an integral flange which forms a tongue 20. In addition, a bead which forms a stop 21, is formed at the junction between the flange 20 and the angle strip portion 17.

The opposite longitudinal edge of each panel section is provided with integral, approximately parallel, outer and inner flanges, 23 and 24, respectively, which define a channel 25. The tongue forming flange 20 of one panel section is manually inserted within the channel 25 of the next adjacent panel section edge and is snugly held within the channel. Thus, the tongue forming flange 20 and the pair of channel forming flanges, 23 and 24 provide a three-layer lamination which produces a flat bar-like reinforcing strip which extends along the longitudinal edges of the adjacent sections.

Figure 7:
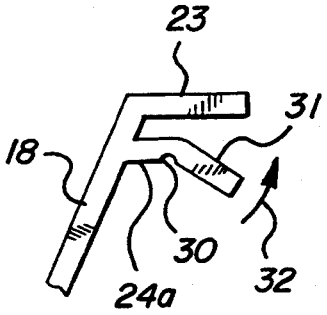
FIG. 7 is an enlarged, fragmentary view, showing the initial position of one of the channel forming flanges.
Figure 8:
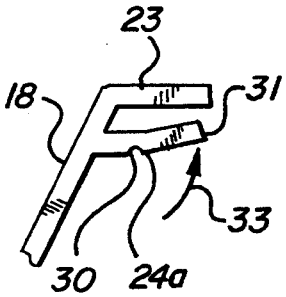
FIG. 8 is a view similar to view FIG. 7, but illustrates the panel forming flange bent toward its opposing flange.
Figure 9:
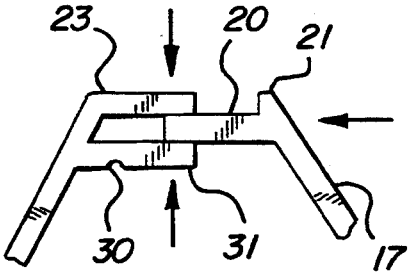
FIG. 9 is an enlarged, fragmentary view, similar to FIG. 8, showing the insertion of a tongue flange between a pair of channel forming flanges.

The tongues are tightly gripped or held, by friction and, also, by the natural resiliency of the channel forming flanges. The resilient and frictional gripping of the channel forming flanges may be enhanced by forming a notch or groove 30 in the inner flange 24*a*, as shown in the modification of FIGS. 7–9, which results in a bent flange end portion 31. That flange end portion is bent toward the opposite flange 23, as indicated by the arrow 32. Then, it may be slightly over bent as indicated by the arrow 33, towards the flange 23 so as to slightly reduce the width of the channel near the channel mouth. Therefore, when the tongue 20 of the adjacent panel section is inserted within the channel, as indicated by the insertion arrow 35 in FIG. 9, the tongue is resiliently squeezed between the flanges 24*a* and 23 as indicated by the arrows 36 in FIG. 9.

In order to provide for rapid assembly of the storm panel, such as when a storm warning is received, the header and sill channels may be permanently installed at an opening which is to be closed by the panel. Alternatively, the header may be permanently installed and the sill may be placed in position and fastened to a floor structure quickly, when desired.

FIG. 2 illustrates, schematically, an extruded metal header 12 which is shaped like an inverted channel having a base 40 and spaced apart parallel legs 41. The header may be fastened, by screws 42, to a ceiling structure 43 and may be kept in place permanently.

The sill 13 may be extruded with a sill base 44 and a rear edge flange 45 and with a short edge bead or flange 46. The sill may be permanently kept in place or may be fastened when desired, to the underlined floor structure 47 by means of screws 48.

The panel sections are normally stored until needed. When needed, the sections are assembled manually, by manually positioning them between the header and the sill and forcing the tongues within the adjacent grooves, as described above. If desired, mechanical fasteners, such a bolts 50 may be inserted through pre-formed openings 51 in the sill flanges 45 and in the sections. The bolts are fastened in place by suitable nuts 52 which may be ordinary nuts or wing nuts. Alternatively, threaded studs could be permanently secured to the flange 45 in place of separate bolts.

The panel sections may be rapidly assembled into the complete storm panel when needed. Conversely, it may be rapidly disassembled when no longer necessary. Significantly, the laminated bar-like strips formed at the adjacent edges of the panel sections act like vertical bars that are spaced apart along the width of the panel. Consequently, the panel is greatly strengthened and rigidified. Wind borne objects or other forcefully striking objects will be prevented from penetrating the panel because of the series of reinforcing bar-like strips that are spaced along the panel. In addition, the impact or force of an object striking a panel is somewhat absorbed by the angled strip 17 and 18 diverging from the laminated strips.

This invention may be further developed within the scope of the following claims. Therefore, having fully described an operative embodiment of this invention, I NOW CLAIM:

What is claimed is:

1. A manually assemblable reinforced corrugated storm panel for temporarily forming a protective closure across a building opening and the like, comprising:

a number of substantially identical, narrow, elongated panel sections which are adaptable to be aligned edge-to-edge along a common plane for forming the assembled panel;

each panel section has a plurality of horizontal portions connected with at least one angled portion so that adjacent panel sections are joined together to provide a corrugated appearance;

each panel section has an integral, substantially flat, narrow, flange formed on one of said horizontal portions of the panel section and extending along one of its elongated edges to provide a tongue;

each panel section having a pair of approximately parallel, substantially flat, narrow flanges integrally formed upon another horizontal portion of the panel section and extending substantially the full length of its opposite elongated edge, said pair of flanges extending outwardly from said angled portion in a direction opposite to which an adjacent horizontal portion extends from said angled portion;

with the parallel flanges being spaced apart a distance substantially equal to the thickness of said tongue, to provide a channel along the edge of each panel section of a depth and width for tightly receiving the tongue of the next adjacent panel section;

the panel sections being manually interconnected and disconnected by manually inserting each tongue within the groove of the next adjacent panel section edge, with the adjacent edges of the panel sections being otherwise substantially free of securement and connection to each other, and with each interfitted tongue and groove thereby forming a three-layer strip extending substantially the full length of the panel sections and forming a horizontal portion of the corrugated panel, with the strips forming a series of parallel, spaced apart, narrow, bar-like reinforcements along the panel to penetration by forcefully striking objects, such as debris hurled against the panel by high winds.

2. A storm panel as defined in claim 1, and with each panel section being formed with channel-like corrugations extending along its full length between its opposite edges.

3. A storm panel as defined in claim 2, and including a panel header formed of a downwardly opening channel shaped to snugly receive the upper edge portion of the assembled panel;

and a lower sill member having a base and an integral side edge flange shaped to receive and engage, the lower edge portion of the assembled panel.

4. A storm panel as defined in claim 3, and including mechanical fasteners, such as screws and bolts, interconnecting the sill side edge flange to the panel at locations where the sill flange and panel engage each other.

5. A storm panel as defined in claim 1, and wherein each tongue is tightly squeezed between the flanges forming the channel within which the tongue is fitted, for tightly holding the three flanges together to form the three-layer script.

6. A storm panel as defined in claim 5, and wherein at least one of the flanges forming each of said channel is slightly resilient for resiliently pressing against and gripping the tongue within its respective channel.

* * * * *